US009247371B2

(12) United States Patent
Yuyama et al.

(10) Patent No.: US 9,247,371 B2
(45) Date of Patent: Jan. 26, 2016

(54) SOUND PROCESSING APPARATUS

(71) Applicant: Yamaha Corporation, Hamamatsu-shi (JP)

(72) Inventors: Yuta Yuyama, Hamamatsu (JP); Masaki Katayama, Hamamatsu (JP); Tomoko Ninomiya, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 547 days.

(21) Appl. No.: 13/661,630

(22) Filed: Oct. 26, 2012

(65) Prior Publication Data

US 2013/0108057 A1 May 2, 2013

(30) Foreign Application Priority Data

Oct. 28, 2011 (JP) ..... 2011-237462

(51) Int. Cl.

| | |
|---|---|
| ***H04R 5/00*** | (2006.01) |
| ***H04S 3/00*** | (2006.01) |
| *H04S 5/00* | (2006.01) |
| *H04S 7/00* | (2006.01) |

(52) U.S. Cl.

CPC ..... *H04S 3/002* (2013.01); *H04S 5/005* (2013.01); *H04R 5/00* (2013.01); *H04S 5/00* (2013.01); *H04S 7/305* (2013.01)

(58) Field of Classification Search

CPC ..... H04S 5/00; H04S 5/005; H04S 7/305; H04R 5/00

USPC ..... 381/17

See application file for complete search history.

(56) References Cited

U.S. PATENT DOCUMENTS

| | | | | |
|---|---|---|---|---|
| 6,091,894 | A * | 7/2000 | Fujita | H04S 1/002 381/17 |
| 2003/0007648 | A1* | 1/2003 | Currell | 381/61 |
| 2005/0185806 | A1* | 8/2005 | Salvador et al. | 381/119 |
| 2005/0185810 | A1* | 8/2005 | Yamada | H04S 3/004 381/309 |
| 2007/0002971 | A1* | 1/2007 | Purnhagen et al. | 375/316 |
| 2007/0160217 | A1* | 7/2007 | Chun | H04S 3/00 381/17 |
| 2009/0304186 | A1* | 12/2009 | Katayama et al. | 381/1 |

FOREIGN PATENT DOCUMENTS

| | | | |
|---|---|---|---|
| JP | 3-247100 | A | 11/1991 |
| JP | 2001-54199 | A | 2/2001 |
| JP | 2009-302666 | A | 12/2009 |

OTHER PUBLICATIONS

Japanese Office Action with English Translation dated Nov. 26, 2013 (six (6) pages).

* cited by examiner

*Primary Examiner* — Matthew Eason
*Assistant Examiner* — Sean H Nguyen
(74) *Attorney, Agent, or Firm* — Crowell & Moring LLP

(57) ABSTRACT

A sound processing apparatus includes a sound processing section configured to produce left and right channel effect signals by conducting a sound process on left and right channel sound signals, a sound image area expanding section configured to produce left and right channel sound image signals by which sound images are localized outside left and right 2-channel speakers, and a signal combining section configured to add the left channel sound signal and the left channel sound image signal, and add the right channel sound signal and the right channel sound image signal.

7 Claims, 4 Drawing Sheets

SOUND PROCESSING APPARATUS

BACKGROUND

The present invention relates to a technique for controlling a sound field.

Conventionally, techniques have been proposed in which sound images are localized outside left and right 2-channel speakers by signal processing performed on left and right two channels. For example, JP-A-2009-302666 discloses a configuration where the component of a specific frequency Fd of a left channel sound signal is suppressed, and then added to a right channel sound signal, and the component of the specific frequency Fd of the right channel sound signal is suppressed, and then added to the left channel sound signal. When the frequency Fd of components to be suppressed is adequately selected, the sound images can be localized outside the left- and right channel speakers.

However, there is a case where a desired sound field effect (for example, a sound field in which senses of presence and spread can be sufficiently felt, and which is sufficiently approximated to a desired sound space) is actually hardly realized by simply expanding the positions of the sound images by the technique of JP-A-2009-302666. In view of the above-discussed circumstances, it is an object of the present disclosure to realize a sufficient sound field effect.

SUMMARY

In order to achieve the above object, according to the present invention, there is provided a sound processing apparatus comprising:

a sound processing section configured to produce left and right channel effect signals by conducting a sound process on left and right channel sound signals;

a sound image area expanding section configured to produce left and right channel sound image signals by which sound images are localized outside left and right 2-channel speakers, by adding a right addition signal and the left channel effect signal and adding a left addition signal and the right channel effect signal, wherein the right addition signal is produced by adding the right channel effect signal and a right delay signal which is obtained by delaying the right channel effect signal, and wherein the left addition signal is produced by adding the left channel effect signal and a left delay signal which is obtained by delaying the left channel effect signal; and a signal combining section configured to add the left channel sound signal and the left channel sound image signal, and add the right channel sound signal and the right channel sound image signal.

For example, the right addition signal is produced by adding the right channel effect signal and a right delay signal which is obtained by delaying the right channel effect signal by a delay time that is in a range from 62.5 microseconds to 125 microseconds, and the left addition signal is produced by adding the left channel effect signal and a left delay signal which is obtained by delaying the left channel effect signal by a delay time that is in a range from 62.5 microseconds to 125 microseconds.

For example, the left channel effect signal produced by the sound processing section indicates a reflected sound from a left front side, and the right channel effect signal produced by the sound processing section indicates a reflected sound from a right front side.

For example, the sound processing section produces the left and right channel effect signals and left rear and right rear channel effect signals by conducting the sound process on the left and right channel sound signals and left rear and right rear sound signals, the sound image area expanding section produces the left and right channel sound image signals so that the sound images are localized between a left channel speaker and a left rear channel speaker, and between a right channel speaker and a right rear channel speaker, and the signal combining section adds the left rear channel sound signal and the left rear channel effect signal, and adds the right rear channel sound signal and the right rear channel effect signal.

For example, the sound processing apparatus further includes a strength adjustment section configured to amplify the left, right, left rear, and right rear channel sound signals by first to fourth coefficients respectively; and a localization control section. The sound processing section includes: a first amplification section configured to amplify the left channel sound signal by a fifth coefficient; a second amplification section configured to amplify the left rear channel sound signal by a sixth coefficient; a third amplification section configured to amplify the right channel sound signal by a seventh coefficient; a fourth amplification section configured to amplify the right rear channel sound signal by an eighth coefficient; a first selection section configured to select one of the left channel sound signal amplified by the first amplification section and the left rear channel sound signal amplified by the second amplification section; and a second selection section configured to select one of the right channel sound signal amplified by the third amplification section and the right rear channel sound signal amplified by the fourth amplification section. The localization control section adjusts the first to eighth coefficients and controls selecting of the first and second selection sections to localize the sound images at target positions.

For example, the sound processing section includes a first delay section configured to delay the left channel sound signal or the left rear channel sound signal selected by the first selection section, and a second delay section configured to delay the right channel sound signal or the right rear channel sound signal selected by the second selection section.

For example, the left rear channel effect signal produced by the sound processing section indicates a reflected sound from a left rear side, and the right rear channel effect signal produced by the sound processing section indicates a reflected sound from a right rear side.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

<First Embodiment>

Figure 1:
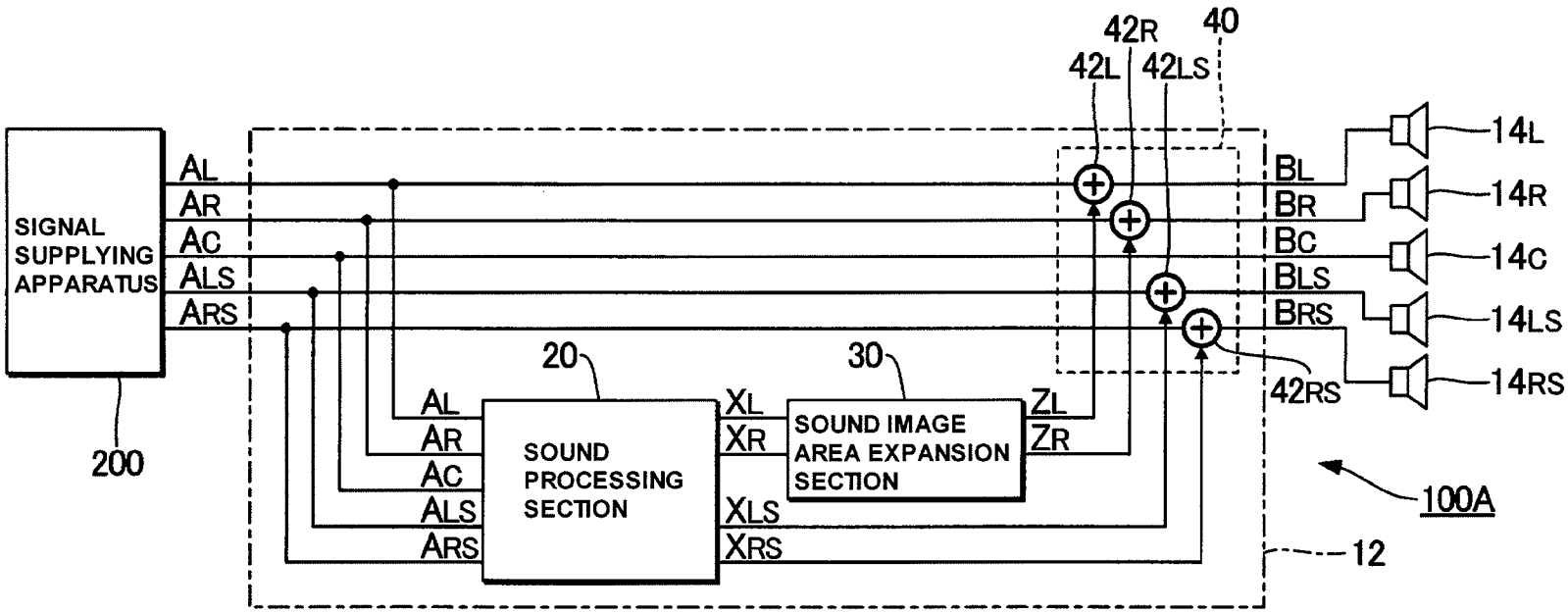
FIG. 1 is a block diagram of a sound system of a first embodiment of the present disclosure.

FIG. 1 is a block diagram of a sound system 100A of a first embodiment of the present disclosure. The sound system 100A of the first embodiment is a surround system which provides a sound field imparting a sense of presence, and includes a sound processing apparatus 12 and five speakers 14 (14C, 14L, 14R, 14LS, 14RS).

Figure 2:
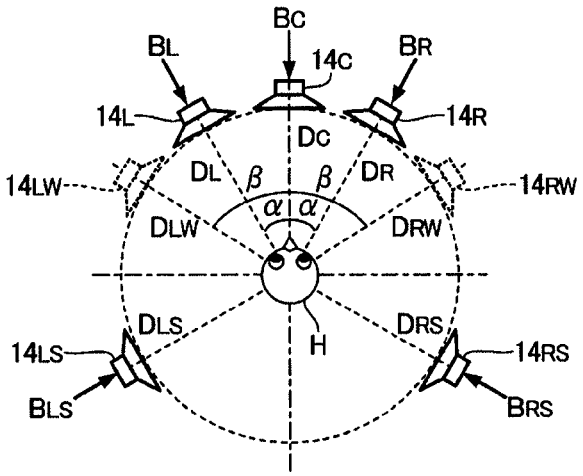
FIG. 2 is a view illustrating placement positions of speakers.

FIG. 2 is a view illustrating positions of the five speakers 14. As shown in FIG. 2, the speakers 14 are placed at positions surrounding the listener H (on the circle circumference of a circle centered at the listener H). Specifically, the speaker 14C is placed in the front direction DC of the listener H, the speaker 14L is placed in a direction DL forming an angle a in a counterclockwise direction with the front direction DC (i.e., on the left front side of the listener H), and the speaker 14R is placed in a direction DR forming the angle a in a clockwise direction with the front direction DC (i.e., on the right front side of the listener H). The angle a is set to, for example, 30°. The speaker 14LS is placed on the left rear side of the listener H (in a direction DLS), and the speaker 14RS is placed on the right rear side of the listener H (in a direction DRS). The sound system 100A may be configured as a 5.1 channel system by adding a speaker for a low frequency range to the five speakers 14.

As shown in FIG. 1, surround 5-channel sound signals A (AC, AL, AR, ALS, ARS) are supplied from a signal supplying apparatus 200 to the sound processing apparatus 12. The sound signals A are digital signals showing acoustic time-waveforms. The sound signals AL, AR localize sound images in front of the listener H, and the sound signals ALS, ARS localize sound images in rear of the listener H. The signal supplying apparatus 200 is a reproduction apparatus which obtains sound signals A from a recording medium such as a DVD (Digital Versatile Disk) and supplies the signals to the sound processing apparatus 12, or a communication apparatus which receives the sound signals A transmitted from another communication terminal through a communication network, and supplies the signals to the sound processing apparatus 12. Alternatively, the sound processing apparatus 12 and the signal supplying apparatus 200 may be integrally configured.

The sound processing apparatus 12 is a signal processing apparatus which produces 5-channel sound signals B (BC, BL, BR, BLS, BRS) from the 5-channel sound signals A. The sound signal BL is supplied to the speaker 14L, the sound signal BR is supplied to the speaker 14R, the sound signal BC is supplied to the speaker 14C, the sound signal BLS is supplied to the speaker 14LS, and the sound signal BRS is supplied to the speaker 14RS. The illustration of Digital-Analog converters which convert the sound signals B to analog signals, and amplifiers which amplify the converted signals are omitted in FIG. 1 for the sake of convenience.

As shown in FIG. 1, the sound processing apparatus 12 includes a sound process section 20, a sound image area expansion section 30, and a signal combination section 40. The sound process section 20 performs a sound process of changing the sound characteristics of the sound signals A. In the first embodiment, the sound process section 20 performs a sound process (reflected sound production process) of producing sound signals (hereinafter, referred to as "effect signals") X (XL, XR, XLS, XRS) of 4-channel reflected sounds (reverberant sounds) from the 5-channel sound signals A (AL, AR, AC, ALS, ARS). The reflected sounds indicated by the effect signals X contain both an initial reflected sound and a rear reverberant sound. The effect signal XL corresponds to reflected sound which arrives at the listener H from the left front side, and the effect signal XR corresponds to reflected sound which arrives at the listener H from the right front side. The effect signal XLS corresponds to reflected sound which arrives at the listener H from the left rear side, and the effect signal XRS corresponds to reflected sound which arrives at the listener H from the right rear side. For example, a known technique such as the sound field control technique disclosed in JP-B-2755208 may be arbitrarily employed in the production of the effect signals X.

The sound image area expansion section 30 produces a sound image signal ZL and a sound image signal ZR from the effect signals XL, XR which are produced by the sound process section 20. In FIG. 2, a direction DLW forming an angle β in a counterclockwise direction with the front direction DC of the listener H, and a direction DRW forming the angle β in a clockwise direction are shown. The angle β is larger than the angle α. The sound image area expansion section 30 produces the sound image signals ZL, ZR so that the sound image in the case where the sound image signal ZL is reproduced by the speaker 14L is localized at the position of a virtual speaker 14LW in the direction DLW (i.e., on the left side of the speaker 14L), and the sound image in the case where the sound image signal ZR is reproduced by the speaker 14R is localized at the position of a virtual speaker 14RW in the direction DRW (i.e., on the right side of the speaker 14R). That is, the sound image signals ZL, ZR localize the sound images of the reproduced sounds outside the speakers 14L, 14R. The sound process section 20 produces the effect signal XL of the reflected sound which arrives in the direction DLW, and the effect signal XR of the reflected sound which arrives in the direction DRW.

Figure 3:
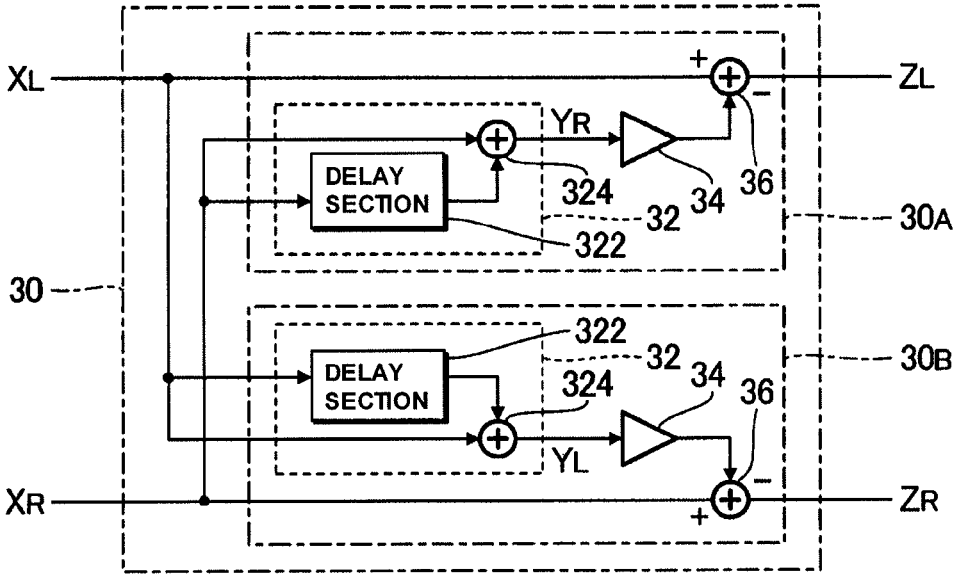
FIG. 3 is a block diagram of a sound image area expansion section.

FIG. 3 is a block diagram of the sound image area expansion section 30. As shown in FIG. 3, the sound image area expansion section 30 includes a first process section 30A and a second process section 30B. The first process section 30A produces the left channel sound image signal ZL from the effect signals XL, XR which are produced by the sound process section 20, and the second process section 30B produces the right channel sound image signal ZR from the effect signals XL, XR.

The first process section 30A includes a filter 32, an amplification section 34, and an addition section 36. The filter 32 is a comb filter which suppresses the component of a specific frequency Fd in the effect signal XR, and includes a delay section 322 and an addition section 324. The delay section 322 delays the effect signal XR by a delay time τ, and the addition section 324 adds the effect signal XR before the delay, and the effect signal XR after the delay together to produce a localization signal YR. The amplification section 34 multiplies the localization signal YR by a predetermined coefficient. The addition section 36 inverts the phase of the localization signal YR which has been amplified by the amplification section 34, and adds the localization signal YR after the phase inversion to the left channel effect signal XL which is produced by the sound process section 20, together (i.e., performs inverted phase addition), thereby producing the sound image signal ZL.

Similarly with the first process section 30A, the second process section 30B includes a filter 32, an amplification section 34, and an addition section 36. The filter 32 of the second process section 30B suppresses the component of the frequency Fd corresponding to the delay time τ in the left channel effect signal XL, thereby producing a localization signal YL, and the amplification section 34 multiplies the localization signal YL by a coefficient. The addition section 36 of the second process section 30B performs inverted phase addition on the localization signal YL which has been amplified by the amplification section 34, and the right channel effect signal XR, thereby producing the sound image signal ZR.

As disclosed in JP-A-2009-302666, in the frequency characteristics of the head-related transfer function of a route along which sound generated by a sound source placed in a direction of an angle θ with the front direction DC indirectly arrives at the listener H, a correlation is observed in which the more angle θ is increased within the range of 30° or larger, the higher frequency of a dip occurring in the range of from 4 kHz to 8 kHz is. In the frequency characteristics of the head-related transfer function, namely, the angle θ of the position of a sound image which is felt by the listener H has a tendency to be further increased as the frequency of a dip occurring in the range of from 4 kHz to 8 kHz is higher.

From the finding, in the first embodiment, similarly with JP-A-2009-302666, the frequency (the lowest one of the frequencies of a plurality of dips existing in the frequency characteristics of the comb filter) Fd which is suppressed in each of the filters 32 of the first and second process sections 30A, 30B is selected so as to have a value corresponding to the desired angle β of the virtual speakers 14LW, 14RW in the range of from 4 kHz to 8 kHz. Specifically, the angle β of the virtual speakers 14LW, 14RW is about 30° in the case where the frequency Fd is set to 5 kHz, about 45° in the case where the frequency Fd is set to 6 kHz, and about 60° in the case where the frequency Fd is set to 6.5 kHz. In the case where attention is focused on the delay time τ in the delay sections 322, when the delay time τ is set within the range from 62.5 microseconds to 125 microseconds, the frequency Fd of the filters 32 is included in the range of from 4 kHz to 8 kHz. Assuming that the sampling frequency of the effect signals XR, XL is 48 kHz, for example, the delay time τ is set to a time length corresponding to three to six samples.

In the sound image area expansion section 30 of the first embodiment, by using the above-described technique of JP-A-2009-302666, the frequency Fd of the filters 32 (the delay time τ in the delay sections 322) is set so that the sound images of the sound image signals ZL, ZR are localized in the directions DLW, DRW of the angle β which is larger than the angle α of the speaker 14L.

The signal combination section 40 in FIG. 1 is configured by four addition sections 42 (42L, 42R, 42LS, 42RS). The addition section 42L adds the sound signal AL supplied from the signal supplying apparatus 200 and the sound image signal ZL produced by the sound image area expansion section 30 together to produce the sound signal BL. Similarly, the addition section 42R adds the sound signal AR and the sound image signal ZR together to produce the sound signal BR. The addition section 42LS adds the sound signal ALS supplied from the signal supplying apparatus 200 and the effect signal XLS produced by the sound process section 20 together to produce the sound signal BLS. Similarly, the addition section 42RS adds the sound signal ARS and the effect signal XRS together to produce the sound signal BRS. The sound signal AC is output as it is as the sound signal BC.

The sound signals B produced in the signal combination section 40 are reproduced by the speakers 14. The sound of the sound signal BC is reproduced by the speaker 14C. The mixed sound (the sound signal BLS) of the sound indicated by the sound signal ALS and the reflected sound indicated by the effect signal XLS is reproduced by the speaker 14LS, and the mixed sound (the sound signal BRS) of the sound indicated by the sound signal ARS and the reflected sound indicated by the effect signal XRS is reproduced by the speaker 14RS. Although the sound signal BL is actually reproduced by the single speaker 14L, the listener H perceives that the sound of the sound signal AL in the sound signal BL is reproduced by the speaker 14L, and the reflected sound indicated by the sound image signal ZL is reproduced by the virtual speaker 14LW. Similarly, although the sound signal BR is actually reproduced by the single speaker 14R, the listener H perceives that the sound of the sound signal AR in the sound signal BR is reproduced by the speaker 14R, and the reflected sound indicated by the sound image signal ZR is reproduced by the virtual speaker 14RW. Therefore, the sound images formed by the sound signals AL, AR are localized in the range between the speakers 14L, 14R, and the sound images of the reflected sounds indicated by the sound image signals ZL, ZR are localized at the position of the virtual speaker 14LW in the direction DLW and at the position of the virtual speaker 14RW in the direction DRW, respectively. Namely, a 7-channel virtual surround system is realized.

In the above-described first embodiment, the listener H perceives that the direct sounds (original sounds) indicated by the sound signals AL, AR arrive from the range between the speakers 14L, 14R, and the reflected sounds indicated by the sound image signals ZL, ZR arrive from the virtual speakers 14LW, 14RW which are outside the speakers 14L, 14R. As compared with the configuration of JP-A-2009-302666 where only the sound image signals ZL, ZR are reproduced, therefore, it is possible to realize an effective sound field effect that provides sufficient senses of presence and spread in which soundally clear direct sounds arrive from the front side, and their reflected sounds arrive from lateral sides.

As a technique for expanding a position where a sound image is localized to regions outside the speakers 14L, 14R, the crosstalk cancelling technique has been proposed in addition to the technique of JP-A-2009-302666. In the crosstalk cancelling technique, the frequency characteristics of the sound path which extends from a left channel speaker to the right ear of the listener are diminished from the right channel sound signal, and the frequency characteristics of the sound path which extends from a right channel speaker to the left ear of the listener are diminished from the left channel sound signal.

However, the crosstalk cancelling technique has problems that a sufficient effect cannot be realized in the case where the planar position of the listener is different from a desired position, and that differences among individuals are caused in effect in accordance with the shape and height of the head of the listener or the like. In the first embodiment, by contrast, the positions of the sound images of the sound image signals ZL, ZR are controlled by controlling the frequency Fd which is suppressed in the filters 32 of the sound image area expansion section 30. Therefore, the sound images of the sound image signals ZL, ZR can be localized outside the speakers 14L, 14R regardless of the position of the listener H, the shape and height of the head, and the like.

<Second Embodiment>

Hereinafter, a second embodiment of the present disclosure will be described. In the following description of the embodiment, components which are equivalent in function and operation to the first embodiment are denoted by the same reference numerals used in the above description, and their detailed description is appropriately omitted.

As a method of localizing a sound image in the range between the speaker 14L and the speaker 14LS (the range from the left front side of the listener H to the left rear side), a method may be supposed in which, for example, the sound signals AL, ALS are mixed with each other in a mixing ration corresponding to the position of the sound image, and then reproduced by the speakers 14L, 14LS. Because of the circumstances where the speakers 14L, 14LS are placed at the positions which are separated from each other by a distance that is larger than that between the speakers 14L, 14R, and where the listener H hardly perceives the localization in the longitudinal direction as compared with that in the lateral direction, however, it is actually difficult to accurately localize a sound image at a desired position by using the sound reproduced by the speaker 14L and that reproduced by the speaker 14LS.

For example, it is assumed that a sound image is to be localized at a position which divides the space between the speakers 14L, 14LS at an angle ratio of 1:2 from the side of the speaker 14L. In the case where the strength ratio of the sound signals AL, ALS is set to a value corresponding to the angle ratio, the sound image tends to be localized at a position which is closer to the speaker 14L than the desired position. On the other hand, in the case where the strength ratio of the sound signals AL, ALS is set to, for example, 3:2 in order to adjust the position of the sound image to the desired position, the sound image is localized at a position which is closer to the speaker 14LS than the desired position. In the above description, attention is focused on a sound image on the left side of the listener H. A similar problem may be caused with respect to a sound image on the right side of the listener H. In the second embodiment, considering the above circumstances, accurate localization of a sound image is realized in a wide range by using the virtual speakers 14LW, 14RW which are realized by the sound image area expansion section 30, in the sound image localization.

Figure 4:
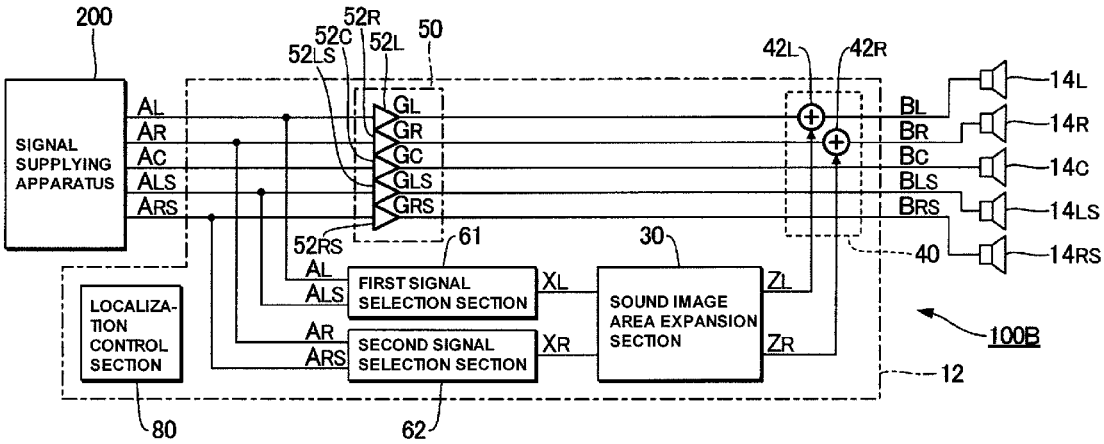
FIG. 4 is a block diagram of a sound system of a second embodiment.

FIG. 4 is a block diagram of a sound system 100B of the second embodiment. As shown in FIG. 4, the sound processing apparatus 12 of the second embodiment is a signal processing apparatus which produces 5-channel sound signals B (BC, BL, BR, BLS, BRS) from the 5-channel sound signals A (AC, AL, AR, ALS, ARS) supplied from the signal supplying apparatus 200, and includes a strength adjustment section 50, a first signal selection section 61, a second signal selection section 62, the sound image area expansion section 30, the signal combination section 40, and a localization control section 80.

The strength adjustment section 50 is configured by five amplification sections 52 (52L, 52R, 52C, 52LS, 52RS) corresponding to the respective channels. The amplification section 52L multiplies the sound signal AL by a coefficient GL, and the amplification section 52R multiplies the sound signal AR by a coefficient GR. The amplification section 52CL multiplies the sound signal AC by a coefficient GC to produce the sound signal BC. Similarly, the amplification section 52LS multiplies the sound signal ALS by a coefficient GLS to produce the sound signal BLS, and the amplification section 52RS multiplies the sound signal ARS by a coefficient GRS to produce the sound signal BRS.

The first signal selection section 61 selects one of the sound signals AL, ALS, and produces the effect signal XL. The second signal selection section 62 selects one of the sound signals AR, ARS, and produces the effect signal XR.

Figure 5:
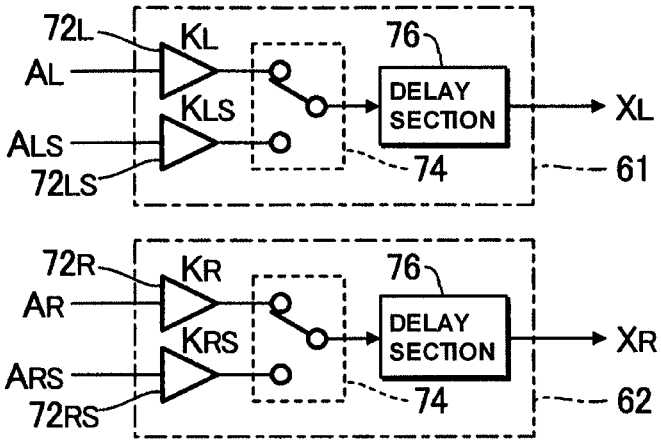
FIG. 5 is a block diagram of first and second signal selection sections.

FIG. 5 is a block diagram of the first and second signal selection sections 61, 62. As shown in FIG. 5, the first signal selection section 61 includes: an amplification section 72L which multiplies the sound signal AL by a coefficient KL, an amplification section 72LS which multiplies the sound signal ALS by a coefficient KLS, a selection section (switch) 74 which selects one of the sound signals AL, ALS, and a delay section 76 which delays the signal selected by the selection section 74 to produce the effect signal XL. In a configuration where the delay section 76 is omitted, the correlation between the sound image signal ZL and the sound signal AL is excessively increased, and there is a possibility that a sound image is perceived at a position which is closer to the speaker 14R than the desired position. The delay section 76 is a component which delays the sound image signal ZL with respect to the sound signal AL to reduce the correlation between them, thereby reducing the error of the sound image position. Similarly with the first signal selection section 61, the second signal selection section 62 includes: an amplification section 72R which multiplies the sound signal AR by a coefficient KR, an amplification section 72RS which multiplies the sound signal ARS by a coefficient KRS, a selection section 74 which selects one of the sound signals AR, ARS, and a delay section 76 which delays the signal selected by the selection section 74 to produce the effect signal XR.

Figure 6:
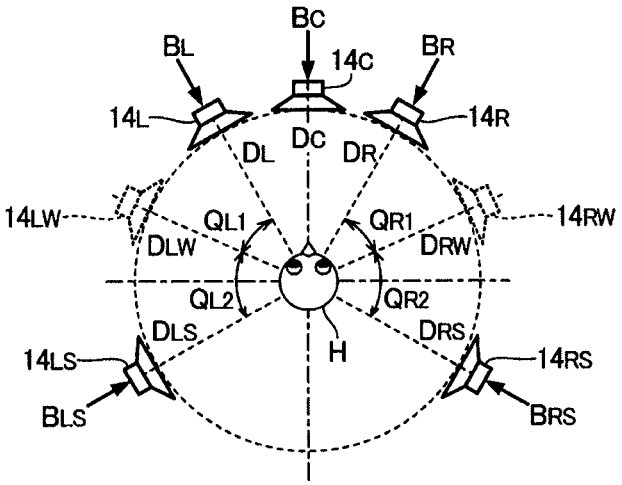
FIG. 6 is a view illustrating placement positions of speakers.

Similarly with the first embodiment, the sound image area expansion section 30 in FIG. 4 produces the sound image signals ZL, ZR from the effect signal XL which is produced by the first signal selection section 61, and the effect signal XR which is produced by the second signal selection section 62. As shown in FIG. 6, specifically, the sound image area expansion section 30 produces the sound image signals ZL, ZR so that the sound image in the case where the sound image signal ZL is reproduced by the speaker 14L is localized in the direction DLW (the virtual speaker 14LW), and the sound image in the case where the sound image signal ZR is reproduced by the speaker 14R is localized in the direction DRW (the virtual speaker 14RW). The sound image area expansion section 30 is configured in a similar manner as in the first embodiment shown in FIG. 3.

The signal combination section 40 in FIG. 4 is configured by two addition sections 42 (42L, 42R). The addition section 42L adds the sound signal AL that has been processed by the amplification section 52L, and the sound image signal ZL produced by the sound image area expansion section 30, together to produce the sound signal BL. Similarly, the addition section 42R adds the sound signal AR that has been processed by the amplification section 52R, and the sound image signal ZR produced by the sound image area expansion section 30, together to produce the sound signal BR. Similarly with the first embodiment, the listener H perceives as if the sound signal AL is reproduced by the speaker 14L, and the sound image signal ZL is reproduced by the virtual speaker 14LW, and the listener H perceives as if the sound signal AR is reproduced by the speaker 14R, and the sound image signal ZR is reproduced by the virtual speaker 14RW.

The localization control section 80 in FIG. 4 variably controls the coefficients (GL, GR, GLS, GRS, KL, KLS, KR, KRS) which are applied to the processes in the sound processing apparatus 12, and controls the selection sections 74 of the first and second signal selection sections 61, 62, whereby a sound image is localized at a target position VL which is between the directions DL, DLS in FIG. 6, and a sound image is localized at a target position VR which is between the directions DR, DRS. As the method of setting the target positions V (VL, VR) of the sound image localization, any method may be arbitrarily employed. For example, a method of setting sound image positions which are estimated from the sound signals A, as the target positions V, or that of determining the target positions V in accordance with instructions given by the user to an input device (not shown) may be preferably employed.

In the case where the target position VL is designated to be in the region QL1 between the directions DL, DLW, the localization control section 80 controls the selection section 74 of the first signal selection section 61 so as to select the sound signal ALS, and controls the coefficient GL of the amplification section 52L, and the coefficient KLS of the amplification section 72LS of the first signal selection section 61 so that the sound image is localized at the target position VL. As the coefficient GL is larger than the coefficient KLS, the localization position of the sound image approaches to the direction DL (the speaker 14L) in the region QL1. By contrast, in the case where the target position VL is designated to be in the region QL2 between the directions DLW, DLS, the localization control section 80 controls the selection section 74 of the first signal selection section 61 so as to select the sound signal AL, and controls the coefficient GLS of the amplification section 52LS, and the coefficient KL of the first signal selection section 61 so that the sound image is localized at the target position VL. As the coefficient GLS is larger than the coefficient KL, the localization position of the sound image approaches to the direction DLS (the speaker 14LS) in the region QL2.

Similarly, in the case where the target position VR is designated to be in the region QR1 between the directions DR, DRW, the localization control section 80 controls the selection section 74 of the second signal selection section 62 so as to select the sound signal ARS, and controls the coefficient GR of the amplification section 52R, and the coefficient KRS of the second signal selection section 62 so that the sound image is localized at the target position VR. As the coefficient GR is larger than the coefficient KRS, the localization position of the sound image approaches to the direction DR (the speaker 14R) in the region QR1. In the case where the target position VR is designated to be in the region QR2 between the directions DRW, DRS, the localization control section 80 controls the selection section 74 of the second signal selection section 62 so as to select the sound signal AR, and controls the coefficient GRS of the amplification section 52RS, and the coefficient KR of the second signal selection section 62 so that the sound image is localized at the target position VR. As the coefficient GRS is larger than the coefficient KR, the localization position of the sound image approaches to the direction DRS (the speaker 14RS) in the region QR2.

As seen from the above description, in the second embodiment, a sound image is localized in the region QL1 by using the sound signal AL reproduced by the speaker 14L and the sound image signal ZL reproduced by the virtual speaker 14LW, and a sound image is localized in the region QL2 by using the sound image signal ZL reproduced by the virtual speaker 14LW and the sound signal ALS reproduced by the speaker 14LS. When compared with the case where the reproduced sound of the speaker 14L and that of the speaker 14LS cause a sound image to be localized between the speakers, therefore, a sound image can be localized at a correct position in a wide range between the speakers 14L, 14LS. Similarly, the speaker 14R and the virtual speaker 14RW cause a sound image to be localized in the region QR1, and the virtual speaker 14RW and the speaker 14RS cause a sound image to be localized in the region QR2. Therefore, a sound image can be localized at a correct position in a wide range between the speakers 14R, 14RS.

Alternatively, the selection section 74 of the first signal selection section 61 may be configured by an adder, and one of the coefficients KL, KLS may be set to zero, so that one of the sound signals AL, ALS can be selected. Similarly, the selection section 74 of the second signal selection section 62 may be configured by an adder, and one of the coefficients KR, KRS may be set to zero, so that one of the sound signals AR, ARS can be selected.

<Modifications>

The embodiments can be modified in various manners. Specific modifications will be exemplarily described. Two or more modifications which are arbitrarily selected from the following exemplifications may be appropriately combined with each other.

(1) In the first embodiment, the 5-channel sound system 100A has been exemplarily described. The present disclosure can be similarly applied also to a left and right 2-channel sound system. In the second embodiment, the speaker 14C may be omitted.

(2) In the first embodiment, the sound process section 20 performs the reflected sound production process of producing the effect signals X (XL, XR, XLS, XRS) of the reflected sound from the sound signals A. The sound process by the sound process section 20 is not limited to the above exemplification. For example, the sound process section 20 may perform a sound process in which a sound effect such as delay, tremolo, chorus, flanger, phaser, or equalizer is imparted.

(3) In the above-described embodiments, after the phase of the localization signal YR is inverted, the signal is added to the effect signal XL in the addition section 36 of the first process section 30A of the sound image area expansion section 30. It is not necessary to invert the phase of the localization signal YR. Namely, a configuration may be employed where the phase of the localization signal YR is differentiated from that of the effect signal XR, and then added to the effect signal XL. Similarly, a configuration may be employed where the phase of the localization signal YL is differentiated from that of the effect signal XL, and then added to the effect signal XR.

Here, the details of the above embodiments are summarized as follows. In order to facilitate understanding of the present disclosure, in the following description, correspondence between components of the present disclosure and those of embodiments are additionally indicted in parentheses. However, this is not intended to limit the scope of the present disclosure to exemplifications of the embodiments.

The sound processing apparatus of the present disclosure includes: a sound processing section which produces left and right channel effect signals by a sound process using left and right channel sound signals; a sound image area expanding section which, to a respective one of the left and right channel effect signals (for example, an effect signal XL and an effect signal XR), adds an addition signal of another one of the left and right channel effect signals, and a signal which is obtained by delaying the other effect signal, together, thereby producing left and right channel sound image signals (for example, a sound image signal ZL and a sound image signal ZR) by which a sound image is localized outside left and right 2-channel speakers; and a signal combining section which adds the left channel sound signal (for example, a sound signal AL) that has not been subjected to the sound process, and the left channel sound image signal that has been processed by the sound image area expanding section, together, and adds the right channel sound signal (for example, a sound signal AR) that has not been subjected to the sound process, and the right channel sound image signal that has been processed by the sound image area expanding section, together. The term "sound process using left and right channel sound signals" includes a sound process using only left and right 2-channel sound signals, and also a sound process using sound signals of three or more channels including the left and right channels.

According to the configuration, the listener perceives as if sounds indicated by the sound signals that have not been subjected to the sound process arrive from the left and right channel actual speakers, and sounds (reflected sound and effect sound) indicated by the sound signals that have been processed by the sound image area expanding section arrive from virtual speakers outside the left and right channel speakers. As compared with the configuration of JP-A-2009-302666, therefore, it is possible to realize an effective sound field effect that provides sufficient senses of presence and spread in which, for example, soundally clear sounds arrive from the front side, and sounds that have been subjected to the sound process arrive from lateral sides.

In a preferred mode of the present disclosure, the sound image area expanding section adds, to the respective one of the left and right channel effect signals, an addition signal of the other one of the left and right channel effect signals, and a signal which is obtained by delaying the other effect signal by a delay time that is in a range from 62.5 microseconds to 125 microseconds. In other words, the sound image area expanding section adds a signal (for example, a localization signal YR or a localization signal YL) in which, in the effect signal of the other one of the left and right channels, components in a range from 4 kHz to 8 kHz are reduced, to the respective one of the left and right channel effect signals. According to the configuration, the sound images of the sound image signals that have been processed by the sound image area expanding section can be effectively localized outside the left and right channel speakers.

Although the kind of the sound process which is performed by the sound processing section may be arbitrarily selected, a configuration is preferable where the sound processing section performs a sound process of, by the sound process using the left and right channel sound signals, producing a left channel effect signal indicating a reflected sound from a left front side, and a right channel effect signal indicating a reflected sound from a right front side. According to the configuration, it is possible to realize an effective sound field effect that provides sufficient senses of presence and spread in which soundally clear direct sounds arrive from the front side, and their reflected sounds arrive from lateral sides.

In a preferred mode of the present disclosure, the sound processing section produces left, right, left rear, and right rear channel effect signals by a sound process using left, right, left rear, and right rear channel sound signals, the sound image area expanding section produces the left and right channel sound image signals so that sound images are localized between left- and left rear channel speakers, and between right and right rear channel speakers, and the signal combining section adds the left rear channel sound signal that has not been subjected to the sound process, and the left rear channel effect signal that has been subjected to the sound process, together, and adds the right rear channel sound signal that has not been subjected to the sound process, and the right rear channel effect signal that has been subjected to the sound process together. According to the configuration, the direct sound and reflected sounds are reproduced also by the speakers which are the left rear and right rear channel speakers with respect to the listener. Therefore, there is an advantage that a preferred continuous sound field can be formed over the whole periphery of the listener.

The sound processing apparatus of each of the above-described modes may be realized by hardware (electronic circuits) such as a dedicated DSP (Digital Signal Processor), or also by a cooperation of a general-purpose calculation processing device such as a CPU (Central Processing Unit), and programs. The program of the present disclosure causes a computer to perform: a sound process of producing left and right channel effect signals by using left and right channel sound signals; a sound image area expansion process of, to a respective one of left and right channel effect signals (for example, an effect signal XL and an effect signal XR), adding an addition signal of another one of the left and right channel effect signals, and a signal which is obtained by delaying the other effect signal, together, thereby producing left and right channel sound image signals (for example, a sound image signal ZL and a sound image signal ZR) by which a sound image is localized outside left and right 2-channel speakers; and a signal combination process of adding the left channel sound signal (for example, a sound signal AL) that has not been subjected to the sound process, and the left channel sound image signal that has been processed by the sound image area expansion process, together, and adding a right channel sound signal (for example, a sound signal AR) that has not been subjected to the sound process, and the right channel sound image signal that has been processed by the sound image area expansion process, together.

According to the program, functions and effects which are similar to those of the sound processing apparatus of the present disclosure are realized. The program of the present disclosure is provided in the form in which the program is stored in a recording medium readable by a computer, and then installed in a computer, or provided in the form of distribution via a network, and then installed in a computer.

A sound processing apparatus (for example, a sound processing apparatus 12 of a second embodiment) of another mode of the present disclosure includes: a strength adjusting unit which adjusts strengths of left, right, left rear, and right rear channel sound signals; a first signal selecting unit which adjusts a strength of one of the left and left rear channel sound signals to produce a left channel effect signal (for example, an effect signal XL in FIG. 4); a second signal selecting unit which adjusts a strength of one of the right and right rear channel sound signals to produce a right channel effect signal (for example, an effect signal XR in FIG. 4); a sound image area expanding section which, to a respective one of left and right channel effect signals, adds an addition signal of another one of the left and right channel effect signal, and a signal which is obtained by delaying the other effect signal, together, thereby producing left and right channel sound image signals by which a sound image is localized outside left and right 2-channel speakers; a signal combining section which adds a left channel sound signal that has been subjected to the strength adjustment, and the left channel sound image signal that has been processed by the sound image area expanding section, together, and a right channel sound signal that has been subjected to the strength adjustment, and the right channel sound image signal that has been processed by the sound image area expanding section, together; a first localization controlling unit (for example, a localization control section 80) which causes the first signal selecting unit to select the left rear channel sound signal, which controls the strength adjustment (for example, a coefficient GL) of the left channel by the strength adjusting unit, and strength adjustment (for example, a coefficient KLS) of the effect signal produced by the first signal selecting unit, to localize a sound image between (for example, a region QL1) the left channel speaker and the left channel virtual speaker, which causes the first signal selecting unit to select the left channel sound signal, and which controls strength adjustment (for example, a coefficient GLS) of the left rear channel by the strength adjusting unit, and the strength adjustment (for example, a coefficient KL) of the effect signal produced by the first signal selecting unit, to localize a sound image between (for example, a region QL2) the left rear channel speaker and the left channel virtual speaker; and a second localization controlling unit (for example, the localization control section 80) which causes the second signal selecting unit to select the right rear channel sound signal, which controls the strength adjustment (for example, a coefficient GR) of the right channel by the strength adjusting unit, and strength adjustment (for example, a coefficient KRS) of the effect signal produced by the second signal selecting unit, to localize a sound image between (for example, a region QR1) the right channel speaker and the right channel virtual speaker, which causes the second signal selecting unit to select the right channel sound signal, and which controls strength adjustment (for example, a coefficient GRS) of the right rear channel by the strength adjusting unit, and the strength adjustment (for example, a coefficient KR) of the effect signal produced by the second signal selecting unit, to localize a sound image between (for example, a region QR2) the right rear channel speaker and the right channel virtual speaker.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2011-237462 filed on Oct. 28, 2011, the contents of which are incorporated herein by reference.

What is claimed is:

1. A sound processing apparatus comprising:

a strength adjusting section configured to adjust strengths of left, right, left rear, and right rear channel sound signals;

a first signal selecting section configured to adjust a strength of one of the left and left rear channel sound signals to produce a left channel effect signal;

a second signal selecting section configured to adjust a strength of one of the right and right rear channel sound signals to produce a right channel effect signal;

a sound image area expanding section configured to produce left and right channel sound image signals whose sound images are localized at positions of left and right channel virtual speakers arranged outside left and right 2-channel speakers, by adding a right addition signal and the left channel effect signal and adding a left addition signal and the right channel effect signal, wherein the right addition signal is produced by adding the right channel effect signal and a right delay signal which is obtained by delaying the right channel effect signal, and wherein the left addition signal is produced by adding the left channel effect signal and a left delay signal which is obtained by delaying the left channel effect signal;

a signal combining section configured to add a left channel sound signal which has been subjected to a strength adjustment of the strength adjusting section and the left channel sound image signal, and add a right channel sound signal which has been subjected to a strength adjustment of the strength adjusting section and the right channel sound image signal;

a first localization controlling section configured to localize a first sound image at a region between the left channel speaker and the left channel virtual speaker by controlling the strength adjusting section so as to control the strength adjustment of the left channel sound signal and the strength adjustment of the left channel effect signal produced by the first signal selecting section, by selecting the left rear channel sound signal at the first signal selecting section, while configured to localize a second sound image at a region between a left rear channel speaker and the left channel virtual speaker by controlling the strength adjusting section so as to control the strength adjustment of the left rear channel and the strength adjustment of the left channel effect signal produced by the first signal selecting section, by selecting the left channel sound signal at the first signal selecting section; and a second localization controlling section configured to localize a third sound image at a region between the right channel speaker and the right channel virtual speaker by controlling the strength adjusting section so as to control the strength adjustment of the right channel sound signal and the strength adjustment of the right channel effect signal produced by the second signal selecting section, by selecting the right rear channel sound signal at the second signal selecting section, while configured to localize a fourth sound image at a region between a right rear channel speaker and the right channel virtual speaker by controlling the strength adjusting section so as to control the strength adjustment of the right rear channel and the strength adjustment of the right channel effect signal produced by the second signal selecting section by selecting the right channel sound signal at the second signal selecting section.

2. The sound processing apparatus according to claim 1, wherein the right delay signal is obtained by delaying the right channel effect signal by a delay time that is in a range from 62.5 microseconds to 125 microseconds; and wherein the left delay signal is obtained by delaying the left channel effect signal by a delay time that is in a range from 62.5 microseconds to 125 microseconds.

3. The sound processing apparatus according to claim 1, wherein the left channel effect signal produced by the first signal selecting section indicates a reflected sound from a left front side; and wherein the right channel effect signal produced by the second signal selecting section indicates a reflected sound from a right front side.

4. The sound processing apparatus according to claim 1, wherein the first and second signal selecting sections produce the left and right channel effect signals and left rear and right rear channel effect signals by conducting a sound process on the left and right channel sound signals and left rear and right rear sound signals;

wherein the sound image area expanding section produces the left and right channel sound image signals so that the sound images are localized between the left channel speaker and the left rear channel speaker and between the right channel speaker and the right rear channel speaker; and wherein the signal combining section adds the left rear channel sound signal and the left rear channel effect signal, and adds the right rear channel sound signal and the right rear channel effect signal.

5. The sound processing apparatus according to claim 4, further comprising:

a strength adjustment section configured to amplify the left, right, left rear, and right rear channel sound signals by first to fourth coefficients respectively; and a localization control section, wherein the first signal selecting section includes:

a first amplification section configured to amplify the left channel sound signal by a fifth coefficient;

a second amplification section configured to amplify the left rear channel sound signal by a sixth coefficient; and a first selection section configured to select one of the left channel sound signal amplified by the first amplification section and the left rear channel sound signal amplified by the second amplification section;

wherein the second signal selecting section includes:

a third amplification section configured to amplify the right channel sound signal by a seventh coefficient;

a fourth amplification section configured to amplify the right rear channel sound signal by an eighth coefficient; and a second selection section configured to select one of the right channel sound signal amplified by the third amplification section and the right rear channel sound signal amplified by the fourth amplification section; and wherein the localization control section adjusts the first to eighth coefficients and controls selecting of the first and second selection sections to localize the sound images at target positions.

6. The sound processing apparatus according to claim 5, wherein the first signal selecting section includes a first delay section configured to delay the left channel sound signal or the left rear channel sound signal selected by the first selection section; and wherein the second selecting section includes a second delay section configured to delay the right channel sound signal or the right rear channel sound signal selected by the second selection section.

7. The sound processing apparatus according to claim 4, wherein the left rear channel effect signal produced by the first signal selecting section indicates a reflected sound from a left rear side; and wherein the right rear channel effect signal produced by the second signal selecting section indicates a reflected sound from a right rear side.

* * * * *